United States Patent [19]

Antonious

[11] Patent Number: 5,004,241

[45] Date of Patent: Apr. 2, 1991

[54] METAL WOOD TYPE GOLF CLUB HEAD WITH INTEGRAL UPPER INTERNAL WEIGHTED MASS

[76] Inventor: Anthony J. Antonious, 205 E. Joppa Rd., Towson, Md. 21204

[21] Appl. No.: 489,253

[22] Filed: Mar. 5, 1990

Related U.S. Application Data

[63] Continuation-in-part of Ser. No. 311,737, Feb. 17, 1989, abandoned.

[51] Int. Cl.[5] ..... A63B 53/04

[52] U.S. Cl. ..... 273/167 H; 273/167 E; 273/169

[58] Field of Search ..... 273/167-175, 273/77 A, 77 R; D21/217-220

[56] References Cited

U.S. PATENT DOCUMENTS

| | | | |
|---|---|---|---|
| 1,568,888 | 1/1926 | Dunn | 273/167 H |
| 2,550,846 | 5/1951 | Milligan | 273/173 |
| 3,468,544 | 9/1969 | Antonious | 273/167 E |
| 3,814,437 | 6/1974 | Winquist | 273/167 R |
| 3,997,170 | 12/1976 | Goldberg | 273/167 E X |
| 4,065,133 | 12/1977 | Gordos | 273/167 E |
| 4,139,196 | 2/1979 | Riley | 273/167 H X |
| 4,432,549 | 2/1984 | Zebelean | 273/167 H |
| 4,828,265 | 5/1989 | Antonious | 273/167 E |

FOREIGN PATENT DOCUMENTS

| | | | |
|---|---|---|---|
| 211781 | 12/1957 | Australia | 273/167 J |

OTHER PUBLICATIONS

"Golf Digest" Magazine, (Dec. 1981 issue), pp. 57-59.

*Primary Examiner*—Edward M. Coven
*Assistant Examiner*—Sebastiano Passaniti
*Attorney, Agent, or Firm*—N. J. Aquilino

[57] ABSTRACT

A metal wood type golf club head is formed of a metal shell including a hollow interior having a first wall thickness. An elongated mass is integrally formed on the underside of the upper surface having a second thickness which extends into the hollow interior of the metal shell locating the center of gravity of the club head in a direction toward the upper surface of the club head.

7 Claims, 3 Drawing Sheets

METAL WOOD TYPE GOLF CLUB HEAD WITH INTEGRAL UPPER INTERNAL WEIGHTED MASS

RELATED APPLICATIONS

The present invention is a continuation-in-part of Ser. No. 07/311,737 filed Feb. 17, 1989, now abandoned entitled Metal Wood Golf Club Head With Integral Upper Internal Weighted Mass.

BACKGROUND OF THE INVENTION

The present invention relates to a golf club head having an improved weight means and, in particular to a metal wood type golf club head having an integrally formed weight structure within the club head cavity and adjacent the top surface thereof. Conventional wood type golf club designs are currently being replaced by metal wood golf club heads formed by a heavy duty metal shell with a hollow interior.

Although metal wood heads have been known for a number of years, as evidenced by the 1926 patent to Dunn U.S. Pat. No. 1,568,888, and the Australian patent to Cates 211781 of 1957, there have been a number of improvements in metal wood head construction as shown in the patent to Zebelean U.S. Pat. No. 4,432,549 and Kochevar U.S. Pat. No. 4,502,687, among others.

More recently, it has been found that moving the weight from the bottom surface of the club head toward the top surface creates a club with more favorable playing characteristics under a number of conditions. Placement of the weight near the upper portion of the club head increases stability of the club head as it is swung, and raises the center of percussion (CP) and/or center of gravity (CG) toward the upper surface of the club head which produces a truer flight path when a ball is properly struck.

The present invention is directed to a metal wood type golf club head having an internal weighting mass directly under and integrally formed with the upper surface of the club head. The weight mass extends in a longitudinal direction from a point adjacent the ball striking face to a second point adjacent the rear of the club head, and is centrally disposed relative to the ball striking face; that is it is above and beyond the center of percussion (CP) on the ball striking face. The mass is relatively wide and extends at least 0.5 inches up to approximately 1.5 inches the entire length of the club head in the front to rear direction.

Preferably, the thickness of the walls of the metal wood club head shell are in the order of 0.060 inches adjacent the top of the club head to a maximum of approximately 0.125 inches near the normally thicker sole. The present invention contemplates using a weighted mass having at least a thickness of 0.200 inches to a maximum of approximately 0.500 inches.

This structure provides a club head with significant upper weight which provides the various advantages described hereinabove. Various embodiments of the club head are contemplated using different size and shape internal weights. A further embodiment provides the exterior of the metal wood golf club head with an aerodynamic slot in the upper surface wherein the internal weight is formed on the underside of the slot within the cavity placing the weight even further toward the geometrical center of the interior of the club head.

Among the objects of the present invention are the provision of a metal wood type golf club head having improved internal weighting system wherein the weight is located adjacent the upper surface and within the metal shell of the club head in a longitudinal direction perpendicular to the ball striking face. These and other objects of the present invention will become apparent with the specification and drawings.

DESCRIPTION OF THE PREFERRED EMBODIMENTS

Figure 1:
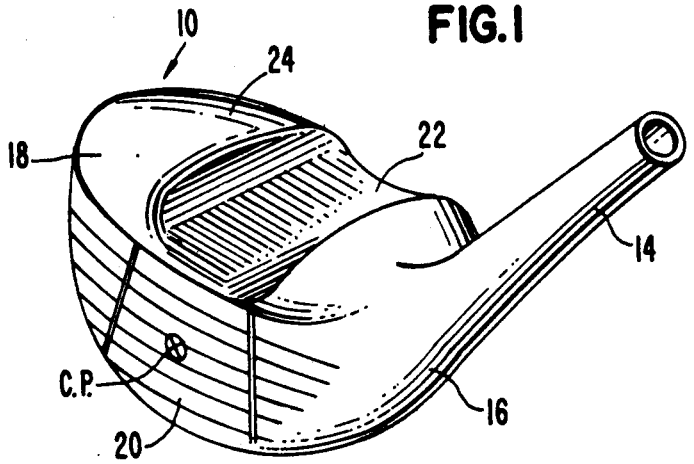
FIG. 1 is a perspective view of a golf club head of the present invention.
Figure 2:
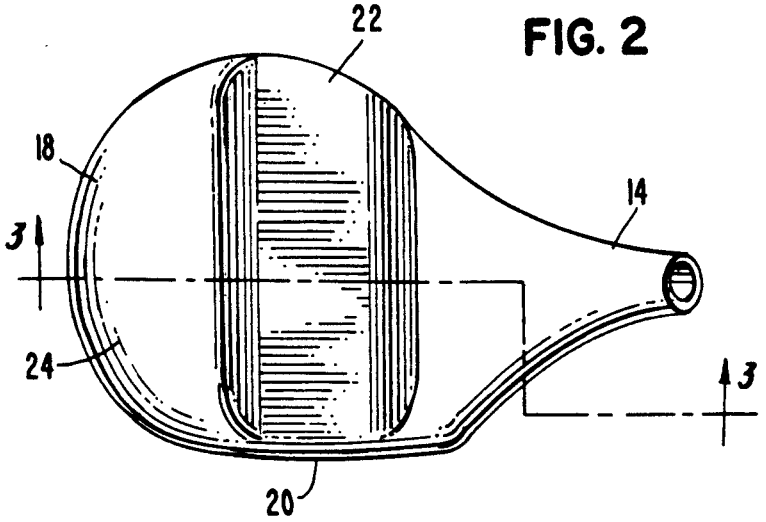
FIG. 2 is a top plan view of FIG. 1.

Referring to the drawings, FIGS. 1 to 4 illustrate a golf club head 10 of the present invention formed of a metal shell and having a hollow interior 12. The club head 10 includes a hosel 14, heel 16, toe 18, and ball striking face 20. In this embodiment, the outer surface of the club head 10 includes an aerodynamic slot 22 formed in the upper surface 24 of the club head 10.

The improved weighting system of the metal wood club head 10 takes the form of an elongated mass 26 integrally formed with the underside of the aerodynamic slot 22 and within the hollow interior 12 of the club head 10. The elongated mass 20 extends rearwardly from a point adjacent the ball striking face 20 and in a direction generally perpendicular to and parallel to the normal intended line of flight of a golf ball struck by the club head 10.

Figure 3:
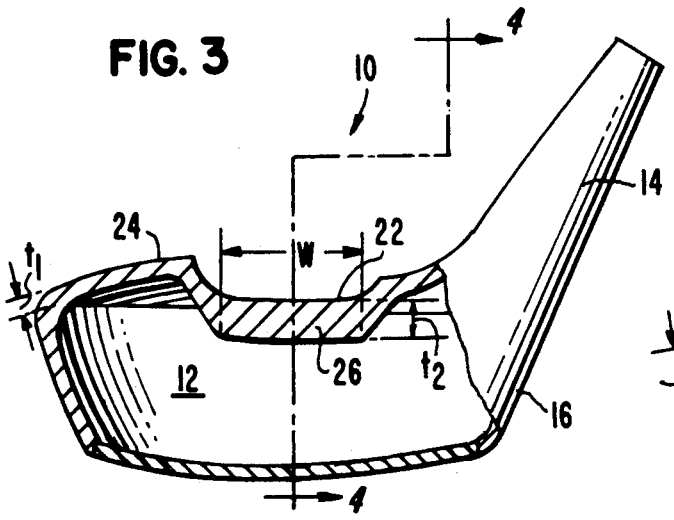
FIG. 3 is a front elevational view taken partly in section along the lines 3—3 of FIG. 2.
Figure 4:
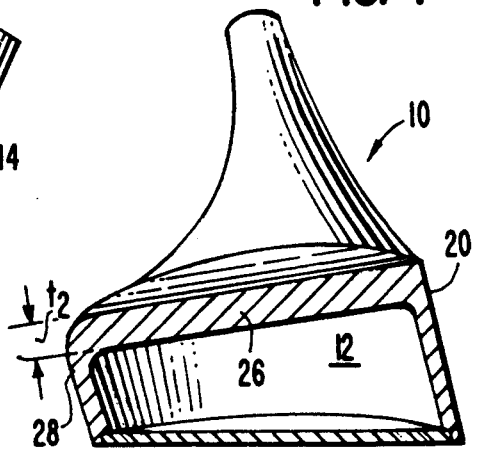
FIG. 4 is a side elevational view in section taken along the lines 4—4 of FIG. 3.
Figure 5:
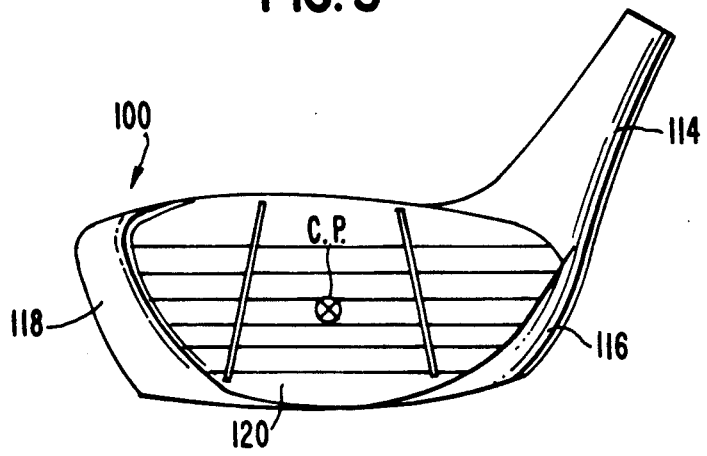
FIG. 5 is a front elevational view of a second embodiment of the present invention.
Figure 6:
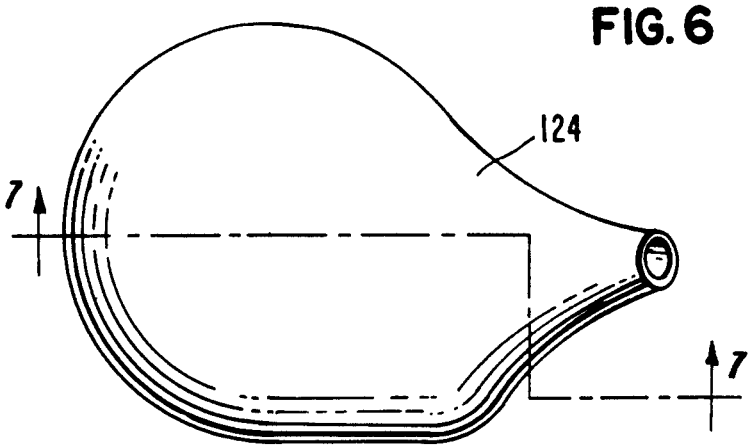
FIG. 6 is a top plan view of FIG. 5.
Figure 7:
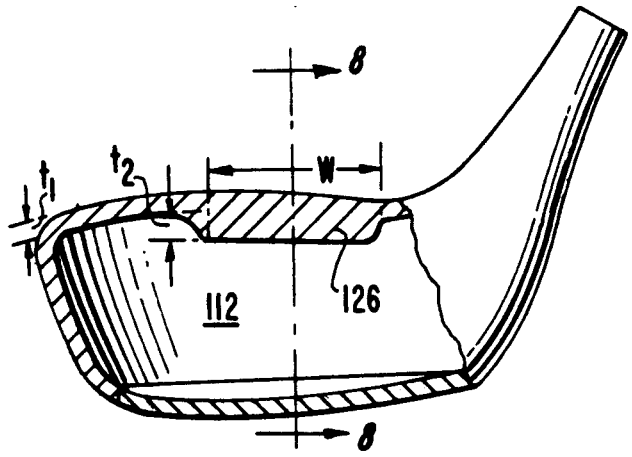
FIG. 7 is a front elevational view taken partly in section along the lines 7—7 of FIG. 6.
Figure 8:
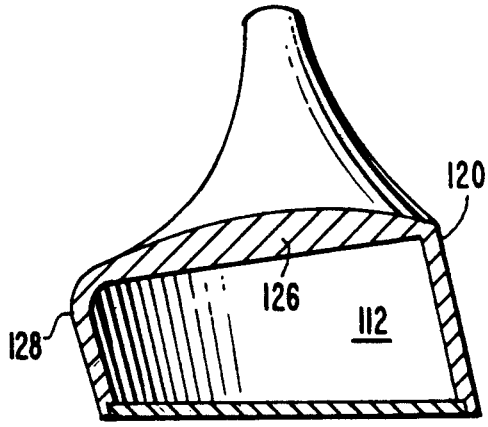
FIG. 8 is a side elevational view in section taken along the lines 8—8 of FIG. 7.

Referring to FIG. 3, the overall thickness t-1 of the club head 10 is preferably in the range of 0.060 inches to 0.125 inches in thickness depending upon the particular material used. A material particularly suited for such club heads is 17-4 stainless steel which provides a high degree of strength for a given thickness in order that the overall weight of the club head be within conventional weight boundaries. With the present invention, the thickness t-2 of the elongated mass 26, which forms the unique weighting system of the present invention, is at least 0.200 inches or thicker depending upon the other dimensions of the club head, and preferably is at least twice the thickness of the club head shell at the upper surface 24. It is possible to make the elongated mass 26 a greater thickness, up to 0.500 inches thick while still maintaining the overall weight characteristics of the club head.

Again, referring to FIG. 3, it can be seen that the width (W) of the elongated mass 26 extends substantially in the heel 16 to toe 18 direction; preferably having a dimension of at least 0.500 inches and up to approximately 1.500 inches.

This configuration permits the overall weight of the club head 10 to be closer to the top surface 24 thereby shifting the center of gravity (CG) and center of percussion (CP) higher onto the ball striking face 20 and upwardly toward the top surface of the club head 10. As indicated previously, the shifting of the weight toward the upper portion of the club head provides more stability to the club head when the ball is impacted, thereby enabling it to fly farther for a given force imparted by a golf swing. It will be appreciated that the width (W) of the elongated mass 26 extends the entire longitudinal distance in the front to rear direction.

FIGS. 5 through 8 illustrate a more conventional type golf club head 100 of the metal wood type including a hollow interior cavity 112, a hosel 114, heel 116, toe 118, and ball striking face 120. In this embodiment, the upper surface 124 is plain in design which provides a smooth aerodynamic configuration. As seen in the sectional view of FIGS. 7 and 8, the improved weighting system is formed by an elongated mass 126 integrally formed on the underside of the upper surface 124 and within the interior cavity 112 of the club head 100. As with the embodiment described hereinabove, the elongated mass 126 is generally rectangular in shape, and extends rearwardly from a point adjacent the ball striking face 120 to a point adjacent the rear surface 128 of the club head 100.

As with the first embodiment, the thickness t-1 of the shell which forms the club head 100 is normally 0.060 inches to 0.125 inches thick depending upon the material used, and depending upon where on the shell that the measurements are taken. The thickness t-2 of the elongated mass 126 is at least 0.200 inches thick, and has a width (W) of at least 0.500 inches to 1.500 one-half inches wide in the heel 116 to toe 118 direction.

Figure 9:
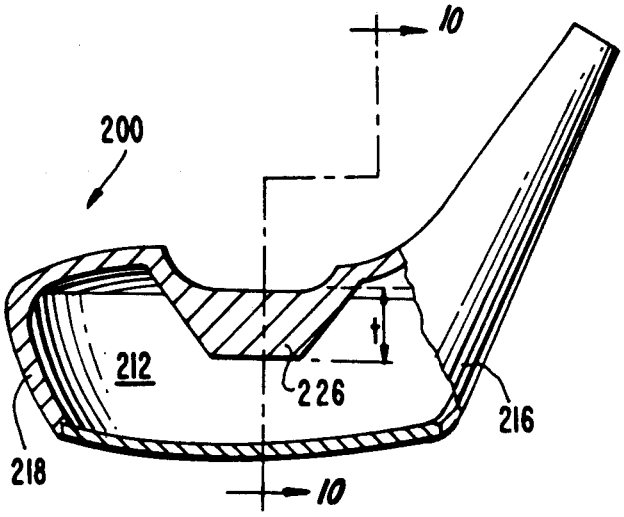
FIG. 9 is a front elevational view taken partly in section of a third embodiment of the present invention.
Figure 10:
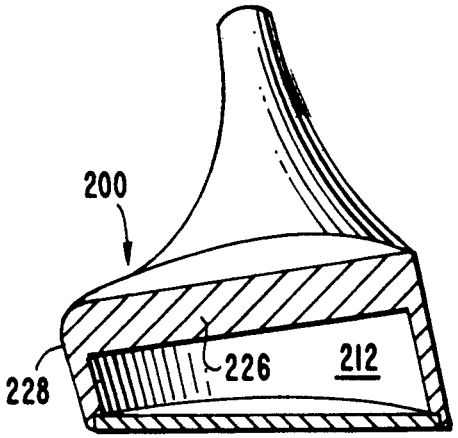
FIG. 10 is a side elevational view in section taken along the lines 10—10 of FIG. 9.

A third embodiment of a club head 200 of the present invention is formed with an elongated mass 226 which is trapezoidal in shape as viewed in section as seen in FIGS. 9 and 10. In this embodiment, the thickness (t) of the elongated mass is approximately 0.500 inches thick which provides a large amount of weight adjacent the top surface, and which extends downwardly within the cavity 212 of the club head 200 so that the weight is more nearly positioned closer to the physical center of the club head 200. As with the other embodiments, the weight extends at least 0.500 inches in width up to 1.500 inches in width in the heel 216 to toe 218 direction, and extends from a point adjacent the ball striking face 220 to a point on the rear surface 228 of the club head 200.

Figure 11:
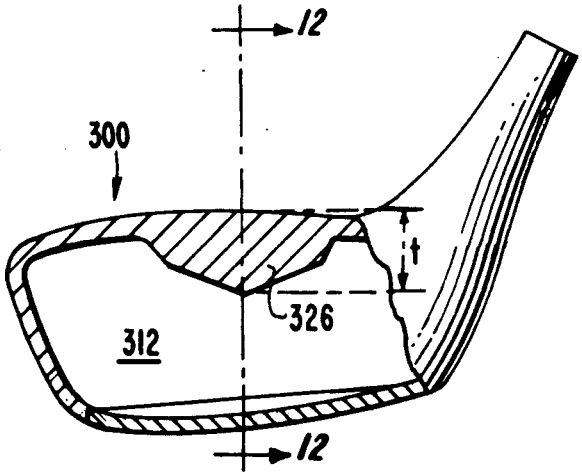
FIG. 11 is a front elevational view taken partly in section of a fourth embodiment of the present invention.
Figure 12:
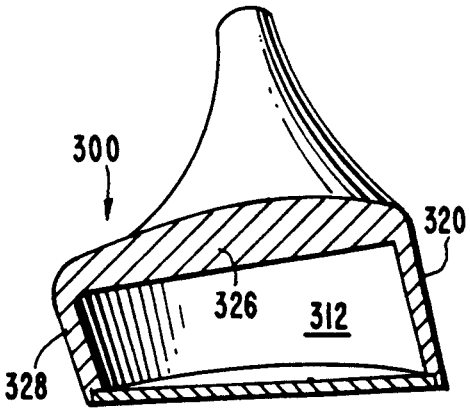
FIG. 12 is a side elevational view in section taken along the lines 12—12 of FIG. 11.

A fourth embodiment of the present invention is illustrated in FIGS. 11 and 12. A metal wood type golf club head 300 having a hollow interior 312 is provided with an elongated mass 326 in the form of an inverted peak as seen in the sectional view of FIG. 11. In this embodiment, the thickness (t) of the elongated mass 326 is approximately 0.500 inches. As with the other embodiments, the weight extends from a point adjacent the ball striking face 320 to a point adjacent the rear surface 328 and also extends at least 0.500 inches to 1.500 inches in width in the heel to toe direction.

In all the above-described embodiments, the weight is located above and behind the center of percussion (CP) on the ball striking face where a golf ball is normally struck. The location of the mass also raises the overall center of gravity (CG) toward the upper surface of the club head, and this improved weight configuration produces more consistantly struck golf shots.

It will be appreciated that although the weight system of the present invention as shown in the longitudinal, generally rectangular or polygonal mass, the weight can assume any geometrical form on the interior side of the upper surface of the club head. Similarly, whereas the weight is shown integrally formed with the club head, it will be appreciated that various removable and/or adjustable weights may be provided in keeping within the scope of the present invention as defined in the following claims.

I claim:

1. A metal wood type golf club head formed of a hollow interior metal shell having inner and outer wall surfaces and a first wall thickness, said club head including a hosel, heel, toe, upper surface, rear surface, ball striking face with a center of percussion thereon wherein the improvement comprises:

an elongated mass integrally formed with said inner wall surface and under said upper surface and extending beyond said inner wall surface into the interior of said metal shell, said elongated mass located between a point adjacent said ball striking face and a second point adjacent said rear surface in a front to rear direction; said elongated means and said metal shell having a second thickness at least twice the thickness of said first wall thickness, said elongated mass centrally disposed relative to the ball striking face between said heel and said toe;

said elongated mass positioning the center of gravity of said club head in a direction toward said upper surface and above and behind said center of percussion on said ball striking face.

2. The club head of claim 1 wherein the inner wall surfaces are void of additional mass in areas away from said elongated mass.

3. The golf club head of claim 1 wherein said first wall thickness is 0.060 inches to 0.125 inches and said second thickness is 0.200 inches to 0.500 inches.

4. The golf club head of claim 1 wherein said elongated mass has a width of 0.5 to 1.5 inches in the heel to toe direction.

5. The club head of claim 1 wherein said elongated mass is rectangular in shape.

6. The club head of claim 1 wherein said elongated mass is formed in the shape of an inverted peak.

7. The club head of claim 1 wherein said elongated mass is trapezoidal in shape.

* * * * *